US009568179B2

(12) United States Patent
Feller et al.

(10) Patent No.: US 9,568,179 B2
(45) **Date of Patent: *Feb. 14, 2017**

(54) MODULAR STACK LIGHT WITH CENTRAL CONNECTORS

(71) Applicant: Rockwell Automation Technologies, Inc., Mayfield Heights, OH (US)

(72) Inventors: Robert P. Feller, Franklin, WI (US); Will J. Preischel, Racine, WI (US); Alvaro Sanchez, Franklin, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/082,247

(22) Filed: Mar. 28, 2016

(65) Prior Publication Data

US 2016/0209017 A1 Jul. 21, 2016

Related U.S. Application Data

(63) Continuation of application No. 14/153,568, filed on Jan. 13, 2014, now Pat. No. 9,307,309.

(51) Int. Cl.
*H04R 1/02* (2006.01)
*F21V 23/06* (2006.01)
(Continued)

(52) U.S. Cl.
CPC ..... *F21V 23/06* (2013.01); *F21S 8/00* (2013.01); *F21S 8/08* (2013.01); *F21V 21/002* (2013.01);
(Continued)

(58) Field of Classification Search
CPC ..... H04R 1/06; H04R 1/025; H04R 1/026; H04R 1/066; H04R 1/105; H04R 1/1008; H04R 1/1016; H04R 1/1021; H04R 2201/021; H04R 2201/107
(Continued)

(56) References Cited

U.S. PATENT DOCUMENTS 3,739,096 A * 6/1973 Iding ..... H04R 1/347 381/338
5,952,915 A 9/1999 Marquardt et al.
(Continued)

FOREIGN PATENT DOCUMENTS

DE 19513983 A1 10/1995
DE 10041202 A1 3/2002
(Continued)

OTHER PUBLICATIONS

Extended European Search Report dated Jul. 8, 2015; Application No. 15150233.3—(6) pages.

*Primary Examiner* — Brian Ensey
(74) *Attorney, Agent, or Firm* — Boyle Fredrickson, SC

(57) ABSTRACT

An in-line sound module for a modular stack light system provides electrical and mechanical connectors to allow it to be placed anywhere in the stack. Axial orientation of the audio transducer and a flexible jumpering system allow preservation of central connectors between modules. In-line configuration permits multiple sound modules to be used in a stack light and to be teamed with different beacon modules. In one embodiment the in-line sound module may also include lamps to provide beacon functionality.

20 Claims, 4 Drawing Sheets

(51) Int. Cl.

| | |
|---|---|
| ***F21S 8/00*** | (2006.01) |
| ***F21S 8/08*** | (2006.01) |
| ***F21V 21/002*** | (2006.01) |
| ***F21V 21/02*** | (2006.01) |
| ***F21V 23/00*** | (2015.01) |
| ***F21V 33/00*** | (2006.01) |
| ***H04R 1/32*** | (2006.01) |
| ***H04R 1/34*** | (2006.01) |
| *F21W 111/00* | (2006.01) |
| *F21Y 101/00* | (2016.01) |

(52) U.S. Cl.
CPC ..... *F21V 21/02* (2013.01); *F21V 23/003* (2013.01); *F21V 33/0056* (2013.01); *H04R 1/028* (2013.01); *H04R 1/323* (2013.01); *H04R 1/345* (2013.01); *F21W 2111/00* (2013.01); *F21Y 2101/00* (2013.01)

(58) Field of Classification Search
USPC ..... 381/381, 395, 386, 387, 390, 394
See application file for complete search history.

(56) References Cited

U.S. PATENT DOCUMENTS

| | | | |
|---|---|---|---|
| 6,632,003 | B2 | 10/2003 | Marquardt et al. |
| 7,545,284 | B2 | 6/2009 | Neumann et al. |
| D673,476 | S | 1/2013 | Clore |
| D684,079 | S | 6/2013 | Clore |
| 2003/0030567 | A1 | 2/2003 | Hetzel et al. |
| 2004/0066142 | A1 | 4/2004 | Stimac et al. |
| 2004/0166743 | A1 | 8/2004 | Kurose et al. |
| 2006/0044814 | A1 | 3/2006 | Ikeda |
| 2008/0242408 | A1 | 10/2008 | Hwang |
| 2009/0267519 | A1 | 10/2009 | Pearse |
| 2013/0314916 | A1 | 11/2013 | Clore |

FOREIGN PATENT DOCUMENTS

| | | | |
|---|---|---|---|
| DE | 10058695 | A1 | 5/2002 |
| DE | 202013102472 | U1 | 6/2013 |
| EP | 1460332 | A2 | 9/2004 |
| EP | 2182776 | A1 | 5/2010 |
| JP | H07282605 | A | 10/1995 |

* cited by examiner

MODULAR STACK LIGHT WITH CENTRAL CONNECTORS

CROSS-REFERENCE TO RELATED APPLICATIONS

This application is a continuation of and claims priority to U.S. application Ser. No. 14/153,568, filed Jan. 13, 2014, the entire contents of which is incorporated herein by reference.

BACKGROUND OF THE INVENTION

The present invention relates to "stack-lights", a structure used to convey operating and warning information in industrial environments, and in particular to a stack light that provides for a sound module that can be placed between beacon modules in the stack.

Stack lights provide a short tower of different colored beacons that may be attached to, or in the proximity to, industrial equipment to provide a visual indication of equipment operating status to workers in the area. The tower promotes the visibility of the beacon lamps at different angles and locations while the different colors of the lamps as well as possible different flashing modes of lamps permit reliable communication of multiple types of information in a possibly noisy environment. In a typical installation, a simple stack light might have a red light indicating a machine failure or emergency, a yellow light indicating warnings such as over-temperature or over-pressure, and a green light confirming correct machine operation. Other combinations and colors are also possible.

Stack lights are typically constructed in a modular fashion, with multiple beacon modules "stacked", the first one on a base unit and then each on top of the next. This modular construction allows the number, color, and order of the beacons to be flexibly selected by customer. Each beacon module includes a lamp (for example an incandescent or LED assembly) held within a transparent housing, for example a cylindrical colored tube, through which the lamp may be viewed. Upper and lower electrical connectors allow interconnection of the beacons to each other or a base to form the tower. Each beacon module also includes an internal electrical conductor system that communicates electrical signals from the bottom of the module to its top so that when the modules are assembled together, electrical continuity is established along the height of the tower between the base and the various modules without the need for separate wiring operations.

Typically each base provides a wire terminal block that may receive electrical wiring from an external switch source that controls the lighting of the beacons. Often that external switch source is an input/output (I/O) module associated with a programmable industrial control unit. Important status information developed during the execution of a control program on the industrial control unit may be relayed to the stack light for display.

In this regard, the stack light normally receives a power "common" together with multiple "signal lines" each which controls the power to a given beacon. The internal electrical connector system of the beacon modules communicates each signal line from the given beacon module to the next beacon module in a manner that shifts the signal wires so to connect a different signal wire to the lamps of each module depending solely on the order of the module in the stack.

It may be desired to add an audio alarm to the beacon modules of the stack light so as to consolidate warning systems in one location. For this purpose, a sound module may be constructed to be placed in the topmost position of the stack to receive electrical signal in the same manner as a beacon module but to energize an audio transducer rather than a lamp.

SUMMARY OF THE INVENTION

The present invention provides a sound module that may be placed in-line between, for example, two beacon modules of a stack light. By permitting such in-line placement, multiple sound modules may be readily placed in a single stack light, and visually desirable upper locations in the light stack may be reserved for beacon modules. In one embodiment, a combined beacon and sound module is provided that may be flexibly placed anywhere in the stack. Providing a combined sound module and beacon module not only conserves tower height but also permits synchronized audio and light messages particularly useful for recorded spoken voices associated with given displays.

Specifically then, in one embodiment, the invention provides an in-line sound module for use in a stack light of the type providing a set of beacon modules interlocking to each other and to a base unit by means of interlocking mechanical connectors and interfitting electrical connectors positioned at a top and bottom of each beacon module and at a top of the base unit, the mechanical connectors and electrical connectors together allowing multiple beacon modules and one base to be mechanically assembled into a tower with electrical communication between the base and each beacon module. The in-line sound module includes a housing having sidewalls defining a chamber between an upper and lower face. First and second mechanical connectors are positioned, respectively, at the upper and lower face and adapted to releasably interlock with corresponding mechanical connectors of the beacon modules or a base, and first and second electrical connectors are positioned, respectively, at the upper and lower face and adapted to releasably interface with corresponding electrical connectors of beacon modules or a base. An audio transducer is held within the chamber to direct sound into the chamber and through openings in the sidewall and electrical conductors extending between the first and second electrical connectors and from the second electrical connector to the audio transducer.

It is thus a feature of at least one embodiment of the invention to provide a sound module that does not need to claim the top position of the tower bus providing improved aesthetics, flexibility, and the ability to use multiple sound modules in a given stack light.

The audio transducer may provide for electrically induced movement along an axis generally centered within the housing extending between the upper and lower faces.

It is thus a feature of at least one embodiment of the invention to permit an orientation of the audio transmitter well adapted for "Omni" radiation patterns and minimizing module height and visual obstruction by the audio transducer.

The active surface of the audio transducer may have an area of at least 50% of a cross-sectional area of the chamber perpendicular to the axis.

It is thus a feature of at least one embodiment of the invention to maximize the area of the audio transducer for increased sound output and low range frequency response.

The first and second electrical connectors may be substantially centered within the upper and lower face and the conductors between the first and second electrical connectors are flexible to route around an edge of the audio transducer.

It is thus a feature of at least one embodiment of the invention to permit use of the sound module with beacons having center connector arrangements.

The conductors between the first and second electrical connectors may be side-by-side parallel conductive elements supported in a common flexible matrix.

It is thus a feature of at least one embodiment of the invention to provide a conductor routing system that permits large transducer areas.

The in-line sound module may further include a sound directing structure within the chamber directing axial sound waves from the audio transducer through a sidewall.

It is thus a feature of at least one embodiment of the invention to provide flexibility in the orientation of the transducer independent of the necessary propagation directions of the sound through the use of a sound director.

The sound directing structure provides a horn element.

It is thus a feature of at least one embodiment of the invention to provide improved acoustic impedance matching between the audio transducer and the surrounding air in a compact in-line module.

The sound directing structure may be movable to change a direction of the directing of axial sound waves from the audio transducer through a sidewall.

It is thus a feature of at least one embodiment of the invention to permit focusing of the sound in particular directions as may be required in a factory environment.

The in-line sound module may further include at least one lamp within the housing and wherein electrical conductors extend between at least one lamp and the second connector.

It is thus a feature of at least one embodiment of the invention to permit combining beacon modules and sound modules, for example, for improved synchronization between sound and beacon activity.

The audio transducer may form one wall of the chamber.

It is thus a feature of at least one embodiment of the invention to provide improved coupling of the audio transducer to air within the chamber.

The invention may provide a plastic dome cover having a lower face having a second mechanical connector adapted to releasably interlock with corresponding mechanical connectors of the beacon modules or the base.

It is thus a feature of at least one embodiment of the invention to permit alternative top treatments for the stack when the sound module need not be placed at the top of the stack.

The plastic dome cover may be transparent and further includes at least one lamp and an electrical conductor positioned on the lower face and adapted to releasably interface with corresponding electrical connectors of the beacon modules or the base.

It is thus a feature of at least one embodiment of the invention to permit the prominent top of the stack to be used for a beacon module.

These particular features and advantages may apply to only some embodiments falling within the claims and thus do not define the scope of the invention.

DETAILED DESCRIPTION OF THE PREFERRED EMBODIMENT

Figure 1:
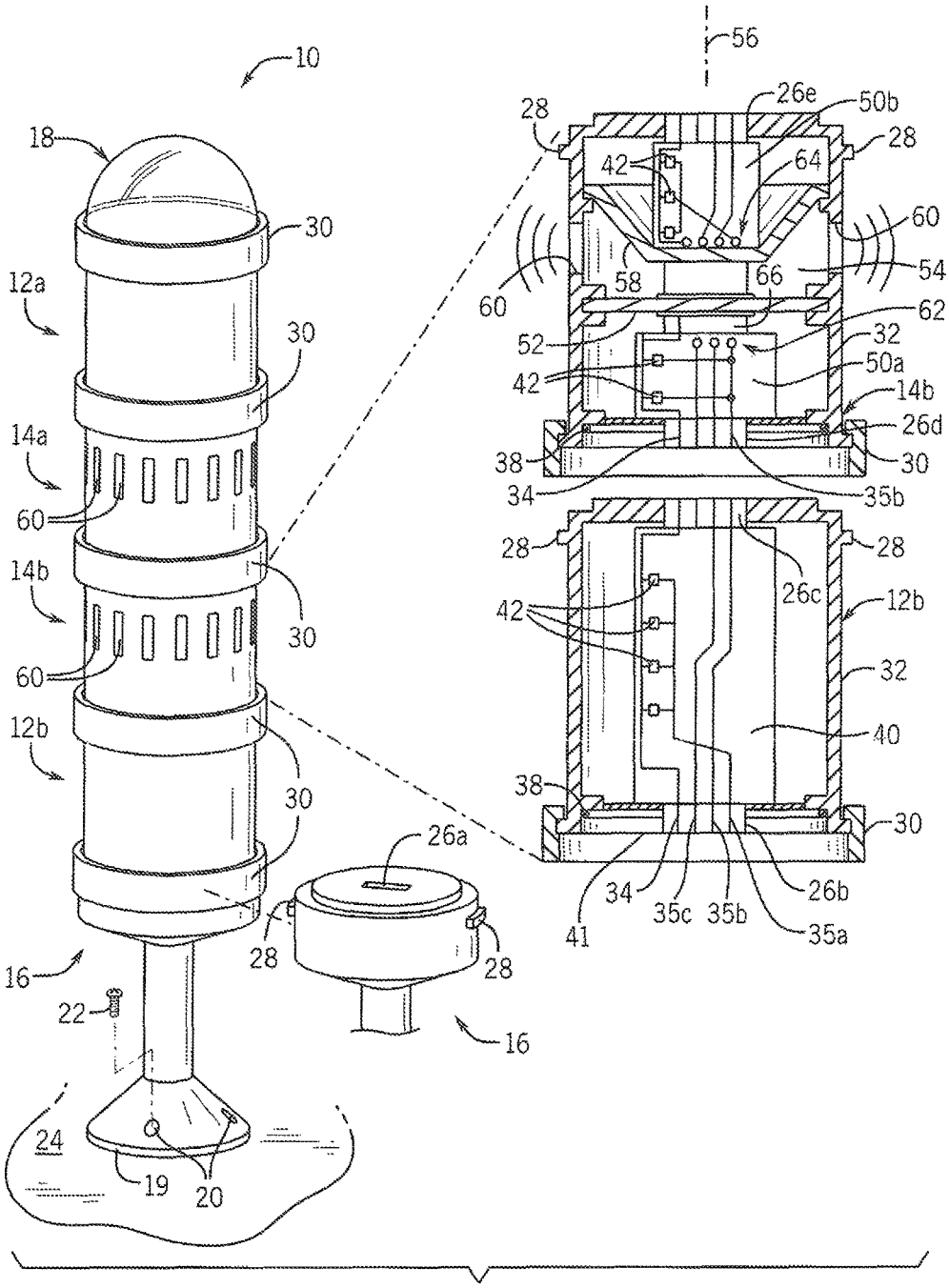
FIG. 1 is a perspective view of a stack light assembled on a base with several beacon modules, in-line sound modules, and a dome and showing elevational cross-sections of one beacon module with one audio in-line module having an internal chamber supporting an audio transducer.

Referring now to FIG. 1, a stack light 10 constructed according to the present invention may be assembled of multiple interlocking beacon modules 12*a* and 12*b* and multiple in-line sound modules 14*a* and 14*b*, a dome 18 and a base module 16.

In one embodiment, the lowest most base module 16 may provide a lower flange 19 having one or more openings 20 for receiving machine screws 22 or the like to fasten the flange 19 and hence the base module 16 to a surface 24 of a machine or the like.

The upper surface of the base module 16 (shown as a figure inset) may expose a centered electrical connector 26*a* that may attach to a corresponding electrical connector 26*b* on the lower surfaces of the lowest beacon module 12*b*.

Generally, a connector similar to electrical connector 26*b* will also be on the lower surface of the other beacon module 12*a* and the in-line sound modules 14*a* and 14*b* and dome 18 (in some embodiments). Further, electrical connectors 26 similar to electrical connector 26*a* will also exist on the upper surface of each of the beacon modules 12 and in-line sound modules 14. In this way, inter-engagement of electrical connectors 26 in the assembled stack light 10 may provide electrical communication between each of the base module, 16 beacon modules 12, in-line sound modules 14 and dome 18 as will be described.

The upper end of the base module 16 also provides a portion of a mechanical interlocking system used to hold the modules together in a tower. This portion of the mechanical interlocking system is in the form of radially extending tabs 28. Similar radially extending tabs 28 exist at the upper end of each of the beacon modules 12 and the in-line sound modules 14.

The radially extending tabs 28 may be received by a second portion of the mechanical interlocking system in the form of twist type bayonet rings 30 rotatably affixed to the lower ends of each of the beacon modules 12, in-line sound modules 14, and dome 18. Such bayonet rings 30, as generally understood in the art, provide ledges on their inner diameter that may capture the radially extending tabs 28 against a helical ledge in the manner of inter-engaging threads while providing a slight pocket at the end of rotation forming a detent that locks the tabs 28 and bayonet rings 30 into predetermined compression.

Inter-engagement tabs 28 and bayonet rings 30 allow the base module 16, the beacon modules 12, the in-line sound module 14, and the dome 18 to be assembled into the stack light 10. This assembly creates a tower extending generally upward from the base module 16 through one or more beacon modules 12 and one or more in-line sound modules 14 each of which may be independently controlled to display a predetermined color of illumination or audio signal depending on the module type. An O-ring seal 38 may be provided at the junction between adjacent attached beacon modules 12, in-line sound modules 14, base module 16, and dome 18 to reduce the ingress of environmental contamination when the modules are connected.

Referring still to FIG. 1, each of the beacon modules 12 and in-line sound modules 14 may provide a housing 32, for example, constructed of electrically insulating thermoplastic. In the following example, where the in-line sound module 14 also provides for beacon functionality, the housings 32 of both of the beacon modules 12 and in-line sound modules 14 will be of transparent (possibly tinted) thermoplastic to allow the passage of light. It will be understood that when an in-line sound module 14 does not include a lamp, an opaque thermoplastic material may be employed.

The housings 32 may generally present a cylindrical periphery in diameter consistent among the modules. Standard diameters for stack lights 10 include 30 mm, 40 mm, 50 mm, 60 mm, 70 mm and 100 mm.

The depicted lowermost beacon module 12*b* may receive from the base module 16 a common voltage along common conductor 34 and multiple signal conductors 35. The conductors may be received through lowermost connector 26*b* when joined with connector 26*a*. In this regard, electrical connectors 26*a* and 26*b*, for example, may be male and female versions of the same connector to be mechanically inter-engageable or may be identical connectors reoriented as in the case of hermaphrodite connector systems.

For simplicity, the electrical connectors 26*a* and 26*b* (and all connectors 26 in FIG. 2) are depicted with only four conductive inserts 41 (for example, conductive pins or sockets) which may each receive the common conductor 34 and three signal conductors 35*a*-35*c*. As is understood in the art, each conductive insert 41 provides an electrically independent conductive path within mating electrical connectors 26.

Referring still to FIG. 1, the connector 26*b* in beacon module 12*b* may be attached to and communicate with, for example, a printed circuit board 40 carrying on it multiple light emitting diodes (LEDs) 42. As shown, LEDs 42 are connected between the common conductor 34 and signal conductor 35*a* attached to inserts 41 occupying the extreme left and right positions of the connector 26*b*. Accordingly, electrical power applied to signal conductor 35*a* will energize the LEDs 42 of beacon module 12*b* so that the light may be viewed through transparent housing 63.

Although the LEDs 42 are shown connected in parallel, series connections are also possible using constant current driving circuitry. Current sharing resistances for each LED 42 when connected in parallel have been omitted for clarity.

The upper edge of the circuit board 40, in turn, may attach to a connector 26*c* being, as noted, identical to connector 26*a*. Circuit traces on a printed circuit board 40 provide common conductor 34 and join identical locations of connectors 26*b* and 26*c* (in the leftmost position as shown in FIG. 1). Signal conductor 35*a* used to control the LEDs 42 of beacon module 12*a* do not pass to connector 26*c*, however, and signal conductors 35*b* and 35*c* are attached to connector 26*c* after being shifted one connector position to the right so that signal conductor 35*b* is now at the rightmost conductive insert 41 of connector 26*c*.

It will be understood that each of the beacon modules 12 and in-line sound modules 14 will have generally the same interconnections between their lower and upper connectors 26. In this way, as signals move upward through the beacon modules 12 or in-line sound modules 14, the identity of the rightmost signal line in the receiving lower connector 26 will be a function of the order of the given module in the stack of the tower. This automatically provides independent electrical conductors from the base module 16 to each given beacon module 12 or in-line sound module 14 according to module stack order without the need for adjustment of the internal wiring of the beacon modules 12 and in-line sound modules 14 or the setting of internal addresses or the like. The number of conductive inserts 41 in the connector 26 and signal conductors 35 determine the limit of the number of beacon modules 12 and in-line sound modules 14 that may be stacked in this manner.

Referring still to FIG. 1, the depicted lowermost in-line sound module 14*b* will have a connector 26*d* engaging with connector 26*c* of lowermost beacon module 12*b* when the two are attached. This connector 26*d* may likewise be attached to a first printed circuit board 50*a* contained within the housing 32 of the in-line sound module 14, but unlike printed circuit board 40 of beacon module 12*b*, circuit board 50*a* extends only part way up the inside of the housing 32 stopping just below an audio transducer 52 forming a lower wall of an audio chamber 54 in the housing 32. This lower wall extends generally perpendicularly to an axis 56 of the housing 32 generally aligned with an axis of symmetry of the cylinder of the housing 32 and extending between the lower connector 26 and an upper connector 26*e* of the housing 32.

The circuit board 50*a* may include a subset of the LEDs 42 of the in-line sound module 14*b* attached in the same manner as in beacon module 12*b*. All of the traces of the printed circuit board 50*a* terminate at solder pads 62 at its upper edge as will be discussed below.

The audio transducer 52 may be a brass plate having an adhered piezoelectric material, or maybe a dynamic audio transducer employing coil and magnet technology as is generally understood in the art. The audio transducer 52 is generally supported at its edges near the inner walls of the housing 32 so that flexure of an active surface of the audio transducer 52 generates acoustic pressure waves traveling upward along axis 56. The edges of the audio transducer 52 may be substantially sealed to the housing 32 to prevent acoustic leakage therethrough.

An upper wall of the audio chamber 54 may be provided by a transparent thermoplastic wall 58 providing a shape that forms an acoustic horn guiding acoustic energy from the transducer 52 out of openings 60 distributed around the side wall of the housing 32. As is understood in the art, an acoustic horn is a shape that provides an improved acoustic impedance match between a sound source and free air.

Figure 2:
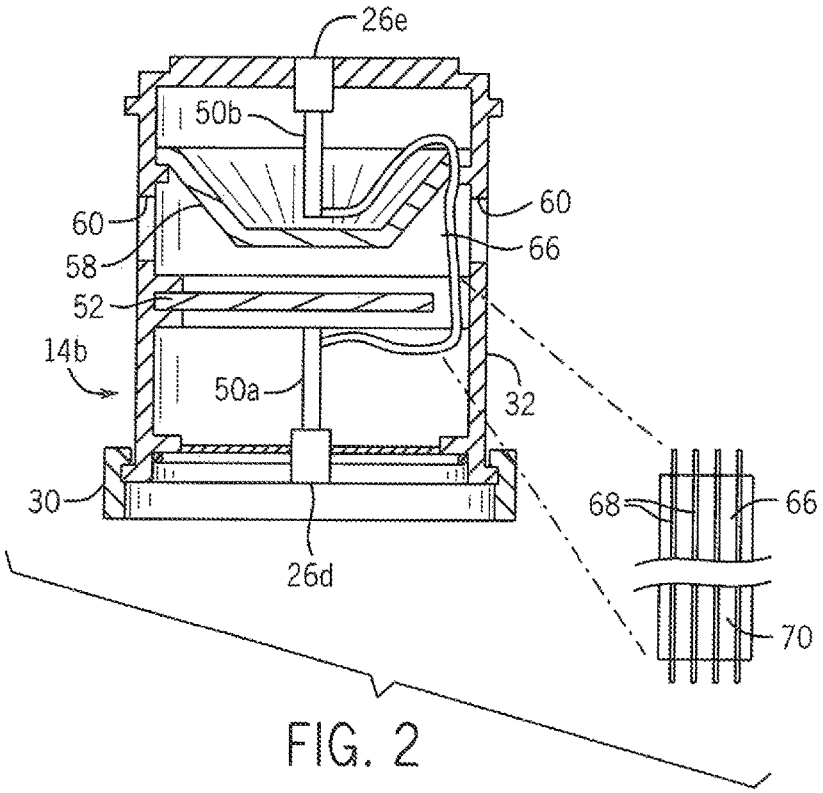
FIG. 2 is an elevational cross-section of the in-line sound module of FIG. 1 taken in a perpendicular plane of the cross-section of FIG. 1 showing the routing of the electrical connections around the audio transducer with a flexible conductor.

A center section of the thermoplastic wall 58 is depressed in the horn shape to receive a second printed circuit board 50*b*. Referring also to FIG. 2, solder pads 64 at a lower edge of the printed circuit board 50*b* may communicate with solder pads 62 of printed circuit board 50*a* by means of a jumper 66, being, for example, a flexible printed circuit board having parallel conductors 68 held in a flexible insulator 70 or a section of ribbon cable or the like. The jumper 66 allows continuity to be established between circuit boards 50*a* and 50*b* despite the interposition of the acoustic transducer 52 by diverting conductors around an edge of the acoustic transducer 52 and wall 58 through small openings for this purpose. The upper edge of circuit board

50*b* attaches to a connector 26*e* in the same manner as described with respect to beacon module 12*b*.

Circuit board 50*b* holds a remaining subset of the LEDs 42, wired as with the previous subset on circuit board 50*a* between the common conductor 34 and the leftmost conductor (in this case, signal conductor 35*b*). The same shifting right of the traces of the printed circuit board 50*b* is performed before receipt of those conductors by connector 26*e* attached at the upper edge of circuit board 50*b*.

Figure 3:
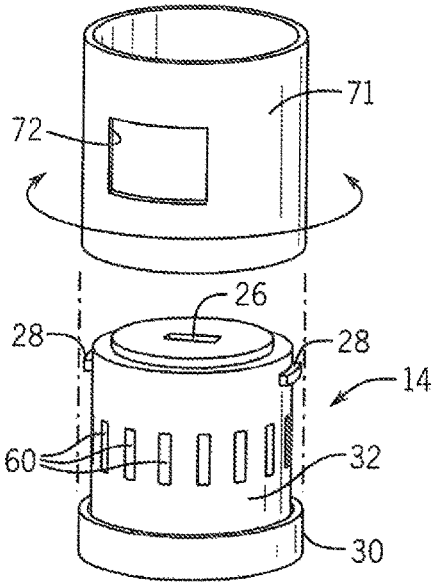
FIG. 3 is an exploded perspective view of an external rotatable sound direction sleeve that may fit over the in-line sound module.

Referring now to FIG. 3, a rotatable sleeve 71 may be fit around the outer cylindrical periphery of the housing 32 of either or both of the in-line sound modules 14 to cover some openings 60 and to expose other opening 60 within a limited angular range aligned with a window 72 in the sleeve 71. In this way, sleeve 71 may be used to direct sound preferentially in a limited range of corrections by rotation of the sleeve 71.

Figure 4:
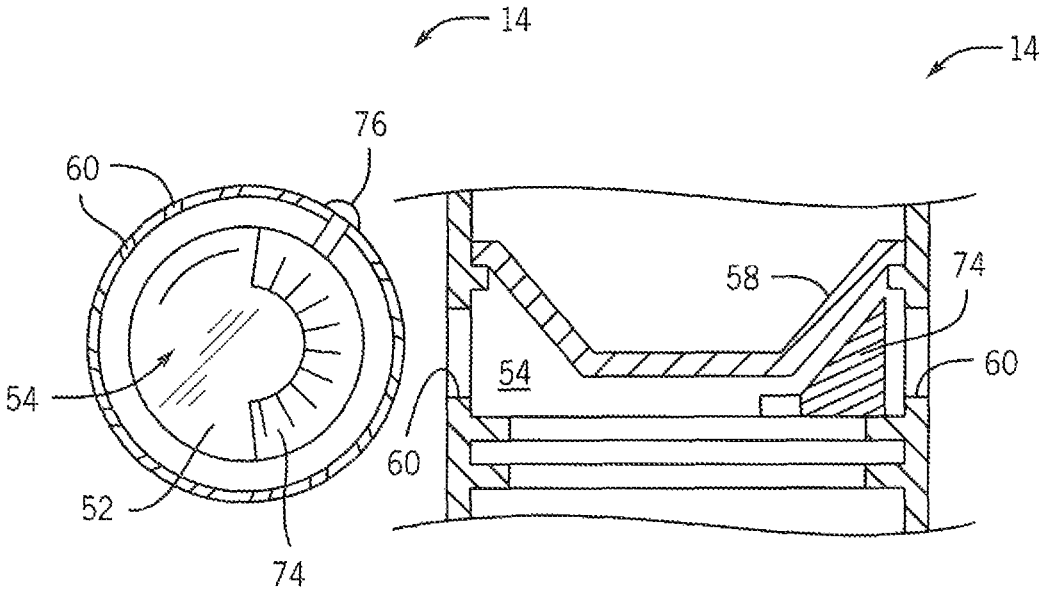
FIG. 4 is a side-by-side plan cross-section and fragmentary elevational cross-section of the chamber of FIG. 1 holding an internal rotatable sound director.

Referring now to FIG. 4, alternatively, a focusing director 74 may be placed inside of the housing 32 between the lower wall of the chamber 54 formed by acoustic transducer 52 and the upper wall 58 of the chamber. This focusing director blocks the exit of sound through a range of the opening 60 to provide a similar focusing of sound in one direction as provided by sleeve 71. Director 74 may be manipulated by means of a knob 76 protruding through a slot passing partially around the outer wall of the housing 32.

Figure 5:
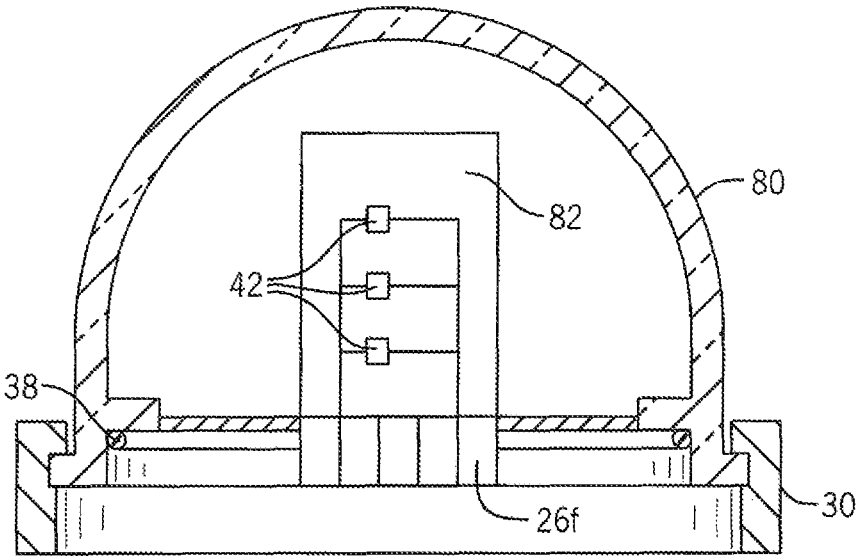
FIG. 5 is an elevational cross-section of a dome module for fitting on top of the stack light.

Referring now to FIG. 5, the construction of an in-line sound module 14 allows the uppermost position of the tower to be occupied, for example, by a simple plastic dome 80 constructed of a transparent thermoplastic material and having a lower bayonet ring 30 to attach to an uppermost beacon module 12 or in-line sound module 14. This dome 80 provides a low profile finished look to the tower that protects any upper connector 26 of the penultimate module. In one embodiment, the dome 80 may also include a circuit board 82 having LEDs 42 to provided beacon functionality. The circuit board 82 is connected at its lower edge to a connector 26*f* so as to permit the dome 80 to receive the necessary signal conductor 35.

Figure 6:
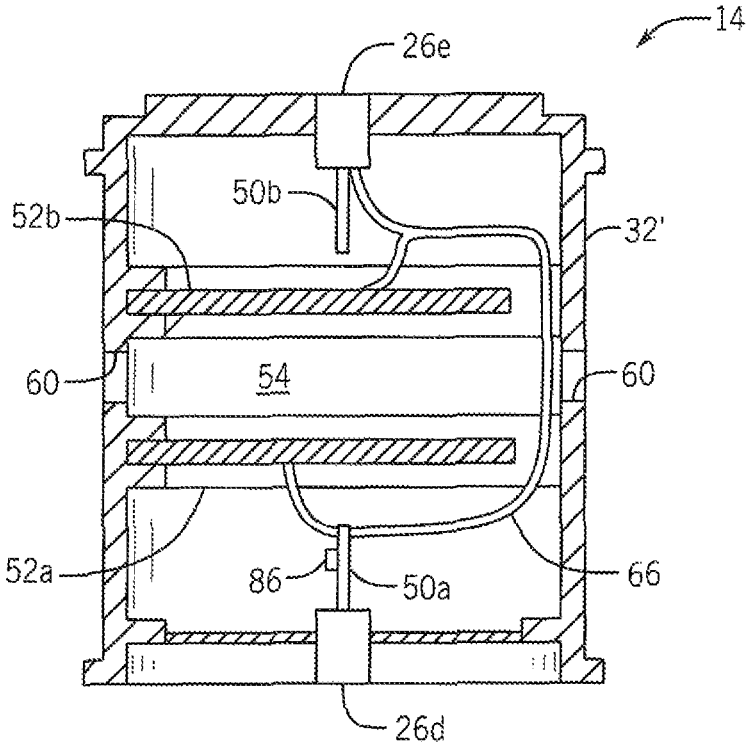
FIG. 6 is an elevational cross-section of an alternative embodiment of the in-line sound module showing alternative transducer locations and a circuit card for synthesis of different audio tones.

Referring now to FIG. 6, it will be appreciated that the in-line sound modules 14 need not include lamp assemblies of LEDs 42 and thus may provide for an opaque housing 32'. In one embodiment, both a lower wall of the chamber 54 and upper wall of the chamber 54 may be formed of separate acoustic elements 52*a* and 52*b*, for example, to provide for greater sound output. Either one of the circuit boards 50*a* or 50*b* may include a sound modulation module 86 allowing a variety of different sounds to be generated beyond a simple steady tone, for example intermittent tones having different frequencies, tones that rise and fall in frequency, and the like.

Figure 7:
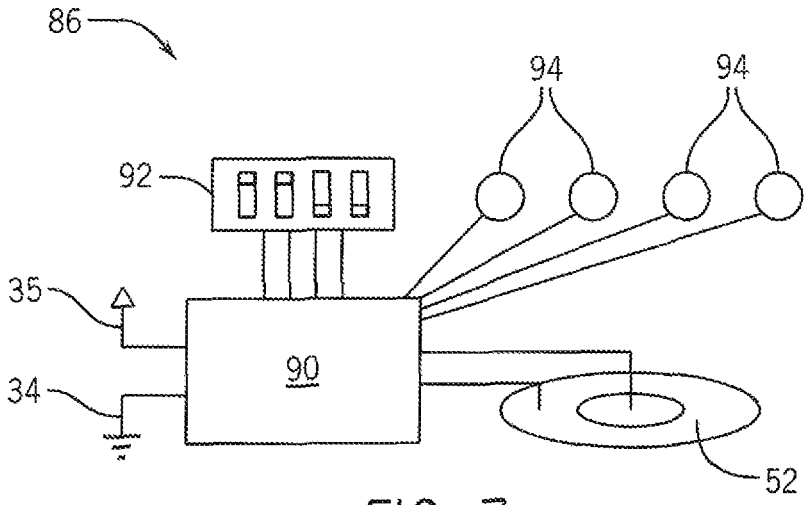
FIG. 7 is a block diagram of an audio synthesis circuit for use with FIG. 6.

Referring to FIG. 7, electrical power from the signal conductor 35 activating the in-line sound module 14 may be provided to a sound function generator 90 communicating with the audio transducer 52 and with a switch 92 and one or more control potentiometers 94 allowing selection of the particular audio tone and its parameters, for example volume, upper tone frequency, lower tone frequency, and modulation speed.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

It is specifically intended that the present invention not be limited to the embodiments and illustrations contained herein and the claims should be understood to include modified forms of those embodiments, including portions of the embodiments and combinations of elements of different embodiments as come within the scope of the following claims.

We claim:

1. An in-line module for use in a stack light of a type providing a set of beacon modules interlocking to each other and to a base unit by means of interlocking mechanical connectors and interfitting electrical connectors positioned at a top and bottom of each beacon module and at a top of the base unit, the mechanical connectors and electrical connectors together allowing multiple beacon modules and one base to be mechanically assembled into a tower with electrical communication between the base and each beacon module, the in-line module comprising:

a housing having sidewalls defining a chamber between an upper and lower face;

a first mechanical connector and a second mechanical connector, the first and second mechanical connectors positioned, respectively, at the upper and lower face and adapted to interlock with corresponding mechanical connectors of the beacon modules or the base unit when the housing of the in-line module is rotated in a first direction and to release from the corresponding mechanical connectors of the beacon modules or the base unit when the housing of the in-line module is rotated in a second direction, wherein the second direction is opposite the first direction;

a first electrical connector and a second electrical connector, the first and second electrical connectors positioned, respectively, at the upper and lower face and adapted to releasably interface with corresponding electrical connectors of beacon modules or the base unit, wherein the first and second electrical connectors are substantially centered within the upper and lower face;

a circuit board extending in a longitudinal direction between the first and second electrical connectors and for at least a portion of a height of the housing of the in-line module, wherein the second electrical connectors are mounted to a first end of the circuit board; and electrical conductors extending within the housing between the first and second electrical connectors.

2. The in-line module of claim 1 wherein the conductors between the first and second electrical connectors are flexible to route along an interior surface of the housing.

3. The in-line module of claim 2 wherein the conductors between the first and second electrical connectors are side-by-side parallel conductive elements supported in a common flexible matrix.

4. An in-line module for use in a stack light of a type providing a set of beacon modules interlocking to each other and to a base unit by means of interlocking mechanical connectors and interfitting electrical connectors positioned at a top and bottom of each beacon module and at a top of the base unit, the mechanical connectors and electrical connectors together allowing multiple beacon modules and one base to be mechanically assembled into a tower with electrical communication between the base and each beacon module, the in-line module comprising:

a housing having sidewalls defining a chamber between an upper and lower face;

a first mechanical connector and a second mechanical connector, the first and second mechanical connectors positioned, respectively, at the upper and lower face and adapted to releasably interlock with corresponding mechanical connectors of the beacon modules or the base unit;

a first electrical connector and a second electrical connector, the first and second electrical connectors positioned, respectively, at the upper and lower face and adapted to releasably interface with corresponding electrical connectors of beacon modules or the base unit, wherein the first and second electrical connectors are substantially centered within the upper and lower face; and electrical conductors extending within the housing between the first and second electrical connectors, wherein:

the first electrical connector includes a first set of connector positions;

the second electrical connector includes a second set of connector positions;

each of the first and second set of terminals includes an identical number of connector positions;

the electrical conductors extending between the first and second electrical connectors include a plurality of signal conductors;

each signal conductor is connected at a first connector position selected from the first set of connector positions;

each signal conductor is connected at a second connector position selected from the second set of connector positions; and the first connector position is shifted one position within the first set of connector positions from the corresponding position of the second connector position within the second set of terminals.

5. The in-line module of claim 4 wherein:

the electrical conductors extending between the first and second electrical connectors further include a reference voltage;

the reference voltage is connected at a third connector position selected from the first set of connector positions;

the reference voltage is connected at a fourth connector position selected from the second set of connector positions; and a position of the third connector position within the first set of connector positions is identical to a position of the fourth connector position within the first set of connector positions.

6. The in-line module of claim 5 further including at least one lamp within the housing.

7. The in-line module of claim 6 wherein each lamp is connected between the reference voltage and one of the signal conductors.

8. The in-line module of claim 6 wherein the lamp is at least one LED.

9. The in-line module of claim 6 wherein the chamber is substantially transparent.

10. The in-line module of claim 1 wherein the circuit board is a first circuit board, the in-line module further comprising:

a second circuit board extending in a longitudinal direction between the first and second electrical connectors and for at least a portion of the height of the housing of the in-line module, wherein the first electrical connectors are mounted to a second end of the second circuit board;

an audio transducer positioned between the first and second circuit boards and within the chamber to direct sound into the chamber and through openings in the sidewall, wherein the audio transducer receives an audio signal from one of the first and the second circuit boards; and electrical conductors extending between a second end of the first circuit board and a first end of the second circuit board.

11. The in-line module of claim 10 wherein the audio transducer provides for electrically induced movement along an axis generally centered within the housing extending between the upper and lower faces.

12. The in-line module of claim 10 further including a sound directing structure within the chamber directing axial sound waves from the audio transducer through a sidewall.

13. The in-line module of claim 12 wherein the sound directing structure is movable to change a direction of the directing of axial sound waves from the audio transducer through a sidewall.

14. The in-line module of claim 10 wherein the audio transducer may form one wall of the chamber.

15. A stack light comprising:

a set of interconnected beacon modules, wherein each interconnected beacon module includes:

a transparent beacon housing;

a first mechanical connector and a second mechanical connector, the first and second mechanical connectors positioned at a top and a bottom of the beacon housing operable to releasably interlock corresponding mechanical connectors of another beacon module;

a first electrical connector and a second electrical connector, the first and second electrical connectors positioned at a top and a bottom of the beacon housing operable to releasably interface with corresponding electrical connectors of another beacon module, wherein the first and second electrical connectors are substantially centered within the top and the bottom of the beacon housing;

a plurality of conductors extending within the beacon housing between the first and second electrical connectors, wherein the plurality of conductors are flexible to route along an interior surface of the beacon housing; and a lamp held within the beacon housing and in communication with one of the plurality of conductors to receive a control signal controlling illumination of the lamp; and a base, wherein the base includes:

a base housing;

a first mechanical connector releasably interlocking with the second mechanical connector of the beacon module;

a first electrical connector releasably interfacing with the second electrical connector of the beacon module, wherein the first electrical connector is substantially centered within a top surface of the base housing;

a terminal block electrically communicating with the first electrical connector, and a mounting flange providing openings for receiving machine screws to attach the mounting flange to a surface.

16. The in-line module of claim 15 wherein the plurality of conductors between the first and second electrical connectors of the beacon housing are side-by-side parallel conductive elements supported in a common flexible matrix.

17. The in-line module of claim 15 wherein:

the first electrical connector includes a first set of connector positions;

the second electrical connector includes a second set of connector positions;

each of the first and second set of terminals includes an identical number of connector positions;

the electrical conductors extending between the first and second electrical connectors include a plurality of signal conductors;

each signal conductor is connected at a first connector position selected from the first set of connector positions;

each signal conductor is connected at a second connector position selected from the second set of connector positions; and the first connector position is shifted one position within the first set of connector positions from the corresponding position of the second connector position within the second set of terminals.

18. The stack light of claim 15 further comprising an in-line sound module, wherein the in-line sound module provides:

a sound module housing;

a first mechanical connector and a second mechanical connector, the first and second mechanical connectors positioned at a top and bottom of the sound module housing, the first mechanical connector releasably interlocking with a corresponding mechanical connector of a given beacon module and the second mechanical connector releasably interlocking with a corresponding mechanical connector of a beacon module or the base;

a first electrical connector and a second electrical connector, the first and second electrical connectors positioned at a top and bottom of the sound module housing, the first electrical connector releasably interfacing with a corresponding electrical connector of a beacon module and the second electrical connector releasably interfacing with a corresponding electrical connector of a beacon module or the base, wherein the first and second electrical connectors are substantially centered within the top and bottom of the sound module housing; and an audio transducer positioned within the sound module housing and receiving electrical power from the second electrical connector to generate an audio signal.

19. The stack light of claim 15 including a plastic dome cover having a lower face having a second mechanical connector adapted to releasably interlock with corresponding mechanical connectors of the beacon modules or the base.

20. The stack light of claim 19 wherein the plastic dome cover is transparent and further includes at least one lamp and an electrical conductor positioned on the lower face and adapted to releasably interface with corresponding electrical connectors of the beacon modules or the base.

* * * * *